United States Patent [19]

Casper et al.

[11] Patent Number: 4,529,114

[45] Date of Patent: Jul. 16, 1985

[54] FORM BURSTER

[75] Inventors: Mark S. Casper, Williamsville; Richard S. Downing; Leonard R. Steidel, both of Grand Island; Robert E. Braungart, Pendelton, all of N.Y.

[73] Assignee: Moore Business Forms, Inc., Grand Island, N.Y.

[21] Appl. No.: 530,861

[22] Filed: Sep. 9, 1983

[51] Int. Cl.[3] ..... B65H 35/10

[52] U.S. Cl. ..... 225/100; 225/4

[58] Field of Search ..... 225/100, 106, 4, 5; 270/52.5

[56] References Cited

U.S. PATENT DOCUMENTS

| | | | |
|---|---|---|---|
| 150,874 | 5/1874 | Mayall . | |
| 2,268,190 | 12/1941 | Copeland et al. | 225/150 |
| 2,639,772 | 5/1953 | Sandberg et al. | 225/100 X |
| 3,481,520 | 12/1969 | Pickering | 225/100 X |
| 3,540,638 | 11/1970 | Hamilton . | |
| 3,543,980 | 12/1970 | Brockmuller . | |
| 3,721,375 | 3/1973 | Roberts et al. . | |
| 3,727,814 | 4/1973 | Kuckhermann . | |
| 3,730,411 | 5/1973 | Brockmuller | 225/100 |
| 3,987,949 | 10/1976 | Manning et al. . | |
| 4,022,364 | 5/1977 | Davis . | |
| 4,025,023 | 5/1977 | Moffitt . | |
| 4,128,886 | 12/1978 | Woolston . | |
| 4,131,272 | 12/1978 | Hartnig | 225/100 X |
| 4,151,403 | 4/1979 | Woolston . | |
| 4,269,341 | 5/1981 | Polko . | |

*Primary Examiner*—Frank T. Yost

*Attorney, Agent, or Firm*—Allegretti, Newitt, Witcoff & McAndrews, Ltd.

[57] ABSTRACT

Apparatus to burst form sets from continuous business form assemblies along burst lines, and adjustable to varying form set depths. An intermittently operatively cooperating pair of entry rollers and an intermittently operatively cooperating pair of exit rollers are on a frame. A first of the entry rollers is rotatable about a first axis of rotation and revolvable about a first axis of revolution. A first of the exit rollers is rotatable about a second axis of rotation and revolvable about a second axis of revolution. The revolutions of the entry and exit rollers are timed relative to each other and adjustably timed relative to the speed of the continuous business form assemblies. Both pairs of rollers operatively cooperate substantially simultaneously with each other. Both pairs of rollers operatively cooperate while burst lines of the assemblies are between the entry rollers and the exit rollers. The periods of intermittency of the roller cooperation coordinates with the depths of the form sets of the assemblies.

28 Claims, 9 Drawing Figures

BURSTING CONDITION

FEEDING CONDITION

BURSTING CONDITION

FORM BURSTER

BACKGROUND OF THE INVENTION

This invention relates to a burster or detacher for detaching form sets from continuous business form assemblies.

A form burster typically has included a pair of low speed rollers through the nip of which a continuous form assembly is fed, followed by a pair of high speed rollers from the nip of which burst form sets exit. The form sets have been burst from the form assembly along transverse perforation lines, by the snap action caused when the leading, unburst form set is accelerated upon entry into the nip of the high speed rollers. Breaker bars and knuckles have been provided to assist bursting along the transverse perforation lines. One such bar has had eccentric knuckles.

Some form bursters have been dedicated to particular form lengths. Others have been adjustable, through lengthening or shortening of the distance between the high speed rollers and the low speed rollers. In an unusual burster, adjustment has been provided by movement of the breaker bar.

Neither dedicated nor adjustable bursters have proven wholly satisfactory. While adjustable bursters are preferred for their versatility, they have been disfavored for their bulkiness and the complexity of construction and operation associated with movement of the roller drives.

SUMMARY OF THE INVENTION

An object of the inventors in making this invention was to advance the art of form bursters by providing a sophisticated but not complex, compact, adjustable burster.

Another object was to provide a burster free of problems of rapid acceleration and deceleration of mechanical components, and excessive noise.

Another object was to provide such a burster capable of consistent, high speed operation.

These and other objects and advantages are provided by the present invention, which, in a principal aspect, is an apparatus adapted to burst form sets along burst lines from continuous business form assemblies. The apparatus is adjustable to varying form set lengths and comprises a frame, and adjustable nip means on the frame for nipping and stressing the assemblies across the burst lines to burst the form sets from the assemblies along the burst lines. The nip means includes nipping elements having movable axes, and adjustable movement means for moving the axes and thereby the nipping elements toward and away from the nipping positions at adjustable time intervals. The movement means moves the axes and nipping elements toward the nipping positions along first paths and away from the nipping positions along second paths.

The full range of objects, aspects and advantages of the invention are best appreciated by a reading of the detailed description of the preferred embodiment, which follows.

BRIEF DESCRIPTION OF THE DRAWING

The preferred embodiment of the invention will hereafter be described in relation to the accompanying drawing. The figures or FIGS. of the drawing are as follows.

DETAILED DESCRIPTION OF THE PREFERRED EMBODIMENT

Figure 1:
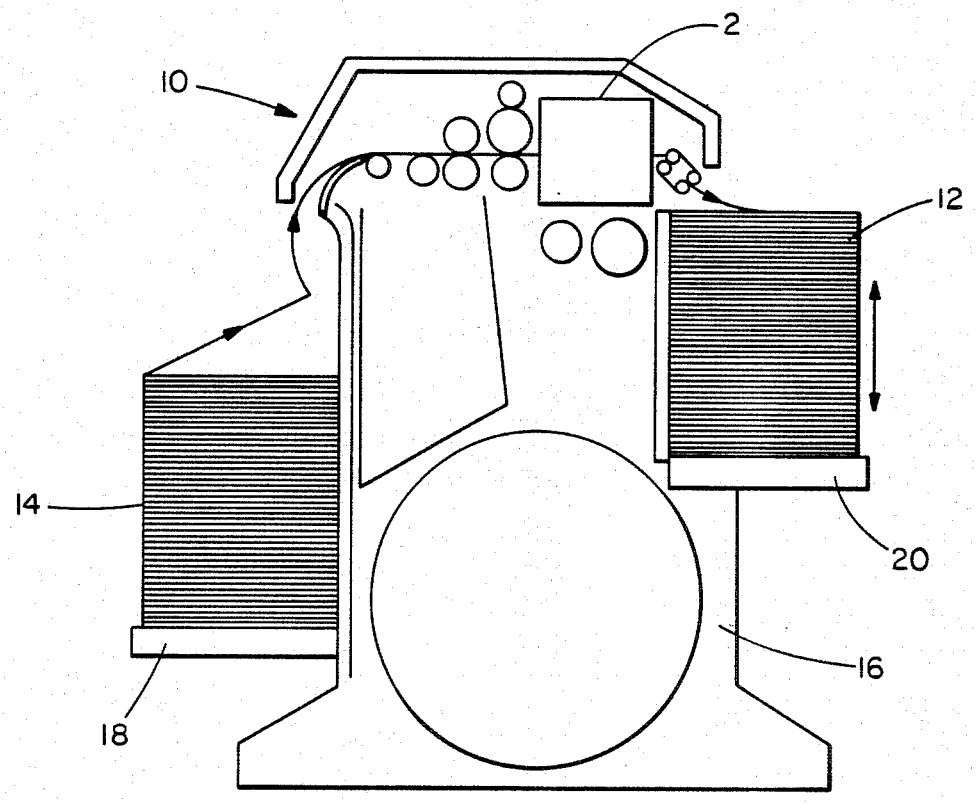
FIG. 1 is a diagrammatic view of the preferred burster of the invention.

Referring to FIG. 1, the preferred embodiment of the invention is a form burster 10 constructed and adapted to burst and stack forms, such as forms 12, from zig-zag folded continuous business form assemblies, such as assembly 14. The burster 10 has a frame 16, and assemblies are fed from a tray 18 on one side of the frame 16, burst into forms atop the frame 16, and stacked on a tray 20 on the other side of the frame 16.

The bursting of the forms is accomplished within the form bursting station 2 of the burster 10. As shown in FIGS. 2–5, the assemblies are fed into the station 2 along a path of travel 22, and the burst forms exit the station 2 along the same path 22.

Figure 3:
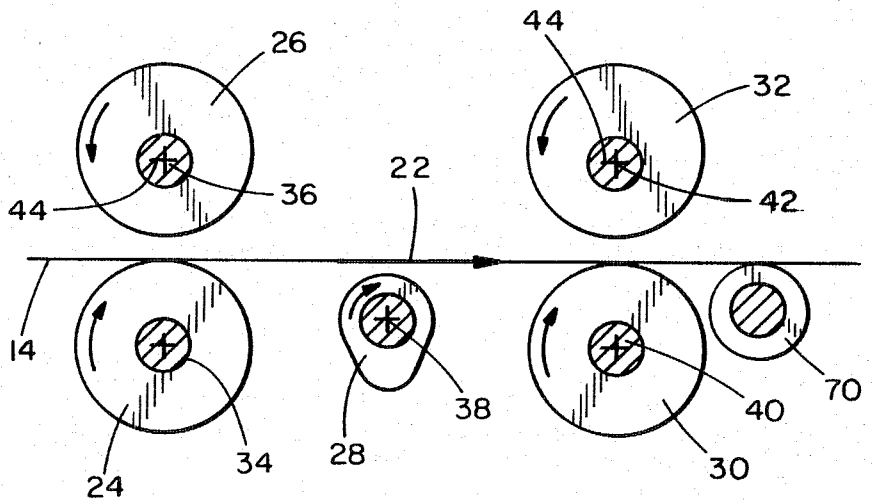
FIG. 3 is a diagrammatic view similar to FIG. 2 of the same portion of the burster, in a second state of operation.

Upon entry into the station 2, an assembly passes between a pair of entry rollers 24, 26, over a breaker 28, and between a pair of exit rollers 30, 32, as in FIG. 3. The rollers 24, 30 have journals 34, 40 mounted to the frame 16, for rotation of the rollers 24, 30 about fixed axes. The breaker 28 is preferably a set of breaker knuckles, eccentrically mounted on a breaker shaft 38 to the frame 16, for rotation about another fixed axis.

The entry rollers 24, 26 and exit rollers 30, 32 are operatively cooperative. During feeding of a form assembly into the bursting station 2, between intervals of bursting, the entry rollers 24, 26 are out of operative cooperation with each other and the exit rollers 30, 32 are out of operative cooperation with each other. Thus, the rollers are intermittently operatively cooperative. The rollers surfaces of the rollers 24, 26, 30, 32 are not stopped when out of operative cooperation, but are all rotating. The rollers 24, 26, 30, 32 are rotating such that the instantaneous points along their circumferences nearest the path of travel 22 are moving parallel to and in the direction of the path 22.

The instantaneous, nearest points of the entry roller 24 and the exit roller 30 are constantly at the path 22. The rollers 24, 30 are concentric on their journals 34, 40. The rollers 24, 30 have uniform diameters along their lengths and throughout their circumferences. Thus, the rollers 24, 30 are supportive of and contribute to feeding of the assemblies in the station 2.

Figure 6:
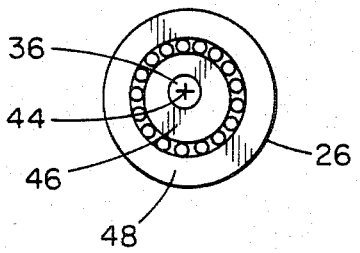
FIG. 6 is an end view of an eccentrically mounted roller of the preferred burster.

The rollers 26, 32 are eccentrically mounted. As shown in FIG. 6, each roller 26, 32, such as roller 26, comprises a cylindrical core such as core 46 eccentric relative to its journals such as journals 36, and an annular roller body 48 which is bearing mounted on the eccentric core 46. So mounted, the body 48 is rotatable concentrically relative to the core 46, and eccentrically relative to the journals 36.

The journals 36 of the core 46 are mounted to the frame 16 to define axes 44, which axes are fixed relative to the frame 16. By definition, the geometric central axes of the roller bodies 48 are the rotational axes of the rollers 26, 32. The axes 44 are axes of revolution of the rollers 26, 32. Rotary movement of the roller bodies 48 is rotation of the rollers 26, 32. Rotary movement of the rollers 26, 32 about the axes 44 is revolution of the rollers 26, 32. To reiterate succintly, the rollers 26, 32 rotate about the geometric centers of the roller bodies 48; they revolve about the axes 44.

When the rollers 26, 32 are revolved toward the path 22, such that the geometric axes of the roller bodies 48 are close to the path 22, the rollers 26, 32 contact assemblies along the path 22 and cooperate with the rollers 24, 30 to nip the assemblies. When revolved through the position where the geometric axes are closest to the path 22, the rollers continue to contact and cooperate, to nip the assemblies. Thus, the rollers 26, 32 cooperate with the rollers 24, 30 through an arc which, by definition, is the arc of dwell. Preferably, the arc of dwell is 90° to 130°, and most preferably, 90 °.

Figure 4:
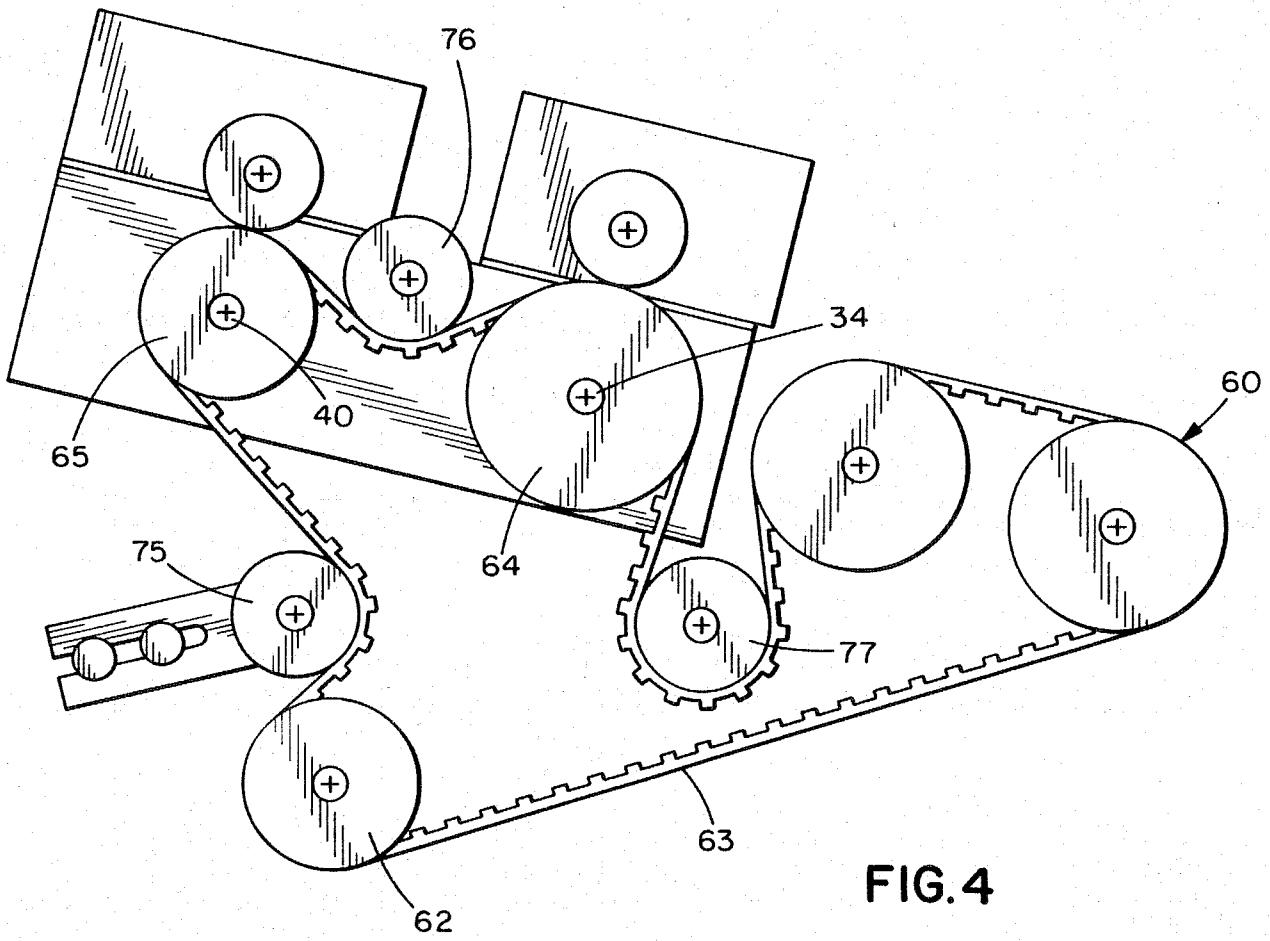
FIG. 4 is a side elevation view of the burster portion of FIGS. 2 and 3, showing a first part of the primary drive of the burster portion.
Figure 7:
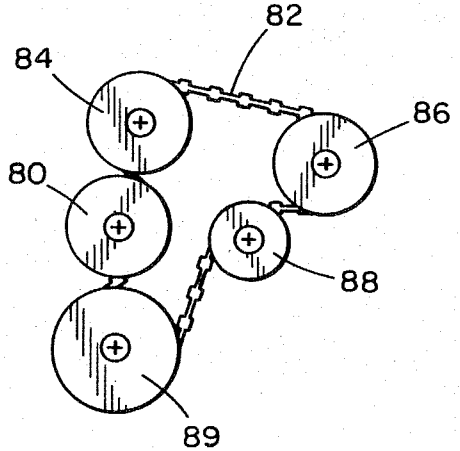
FIG. 7 is a side elevation view, showing a second part of the primary drive.
Figure 5:
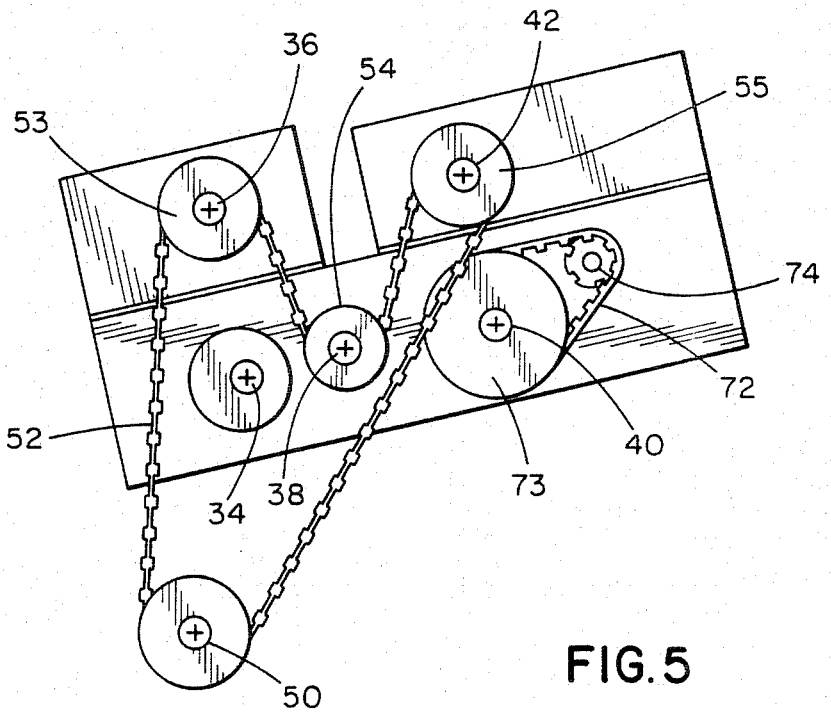
FIG. 5 is an opposite side elevation view, showing the timed eccentric shaft drive.

Referring now to FIGS. 4, 5 and 7, the burster 10 includes two drives, a primary or rotational drive, and a secondary or revolutionary drive. The primary drive rotates all the rollers 24, 26, 30, 32. The secondary drive revolves the rollers 26, 32 and the breaker 28. The rollers 30, 32 are rotated approximately 1.5 times as fast as the rollers 24, 26.

Figure 2:
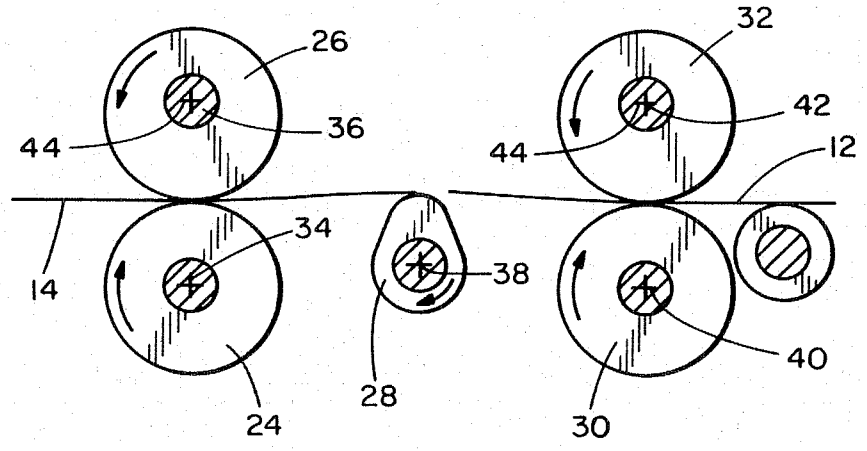
FIG. 2 is a diagrammatic view of the portion of the preferred burster outlined by line 2 in FIG. 1 in a first state of operation.

Referring to FIGS. 2–4, the rollers 24, 30 and a feed means 60 such as a tractor drive for feeding the assemblies into the rollers 24, 26 are driven by a main drive motor 62 through a toothed belt 63 and timing belt pulleys 64–65. The pulleys 64–65 are concentrically mounted on the rollers 24, 30.

Referring to FIGS. 2, 3, and 7, the rollers 26, 32 are also driven in rotation by the main drive motor 62. A timing belt pulley 80 is concentrically mounted on the roller 30 opposite the pulley 65. Thus, the roller 30 transmits the driving force of the motor 62 to the pulley 80. A toothed belt 82 transmits motion from the pulley 80 to pulleys 84, 86. The pulleys 84, 86 are concentrically mounted to the roller bodies 48 of the rollers 26, 32.

Revolution of the rollers 26, 32 revolves the pulleys 84, 86. The belt 82 accommodates the revolution. Idler pulleys 88, 89 provide tension in the belt 82.

Referring to FIG. 5, the cores 46 of the rollers 26, 32 and the breaker 28 are driven by a servo motor such as a D.C. servo motor 50 through a toothed timing belt 52 and toothed pulleys 53–55. The eccentricities of the cores 46 are statically timed or positioned for simultaneous nipping, or operative cooperation, of the pairs of rollers 24, 26 and 30, 32. Referring to FIGS. 3 and 5, the feed means 70 for feeding the burst form sets from the station 2 is driven from the shaft of the roller 30 by a toothed belt 72 and pulleys 73, 74. Idlers 75, 76, 77 provide tension in the belt 63.

The motors 50, 62, belts 52, 63 and pulleys 53–55 and 64–65 comprise, in part, a driving and timing means for driving and timing the rollers 24, 26, 30, 32 and the breaker 28. The rollers are timed relative to each other such that as the assembly 14 is fed into the station 2, the rollers 26, 32 revolve toward positions of engagement with the rollers 24, 30. As the assembly 14 approaches a position such that a line of transverse perforations between form sets is over the breaker 28, the rollers 26, 32 engage the rollers 24, 30. Simultaneous with proper positioning of the assembly for bursting, the rollers and breaker burst the assembly. The leading form set is pulled by the exit rollers 30, 32, while the remainder of the assembly is held against pulling by the rollers 24, 26. The leading form is stressed until burst from the assembly along the line of perforations over the breaker, and then accelerated from the station 2 by the higher speed rollers 30, 32.

The speeds of the motors 50, 62 are adjustable. The speed of the motor 62 is either manually or automatically adjusted relative to the throughput desired for the burster 10. The speed of the motor 50 is adjusted relative to the throughput and the lengths of the form sets of the assemblies. Higher speeds of the motor 50 coordinate with shorter forms, because the assemblies having shorter forms move into bursting position more frequently.

Figure 8:
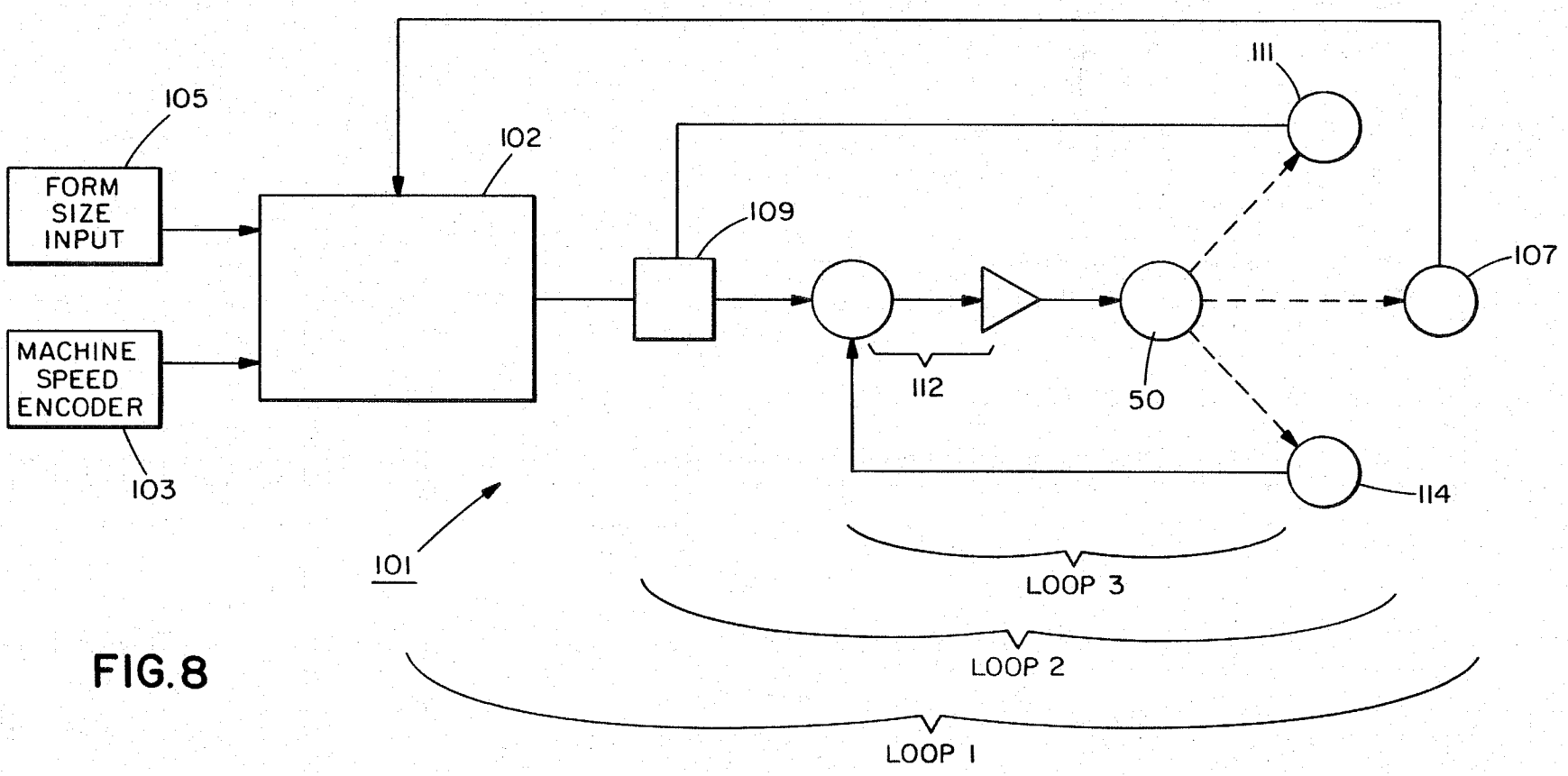
FIG. 8 is a first schematic view of the electronic controller of the preferred burster.
Figure 9:
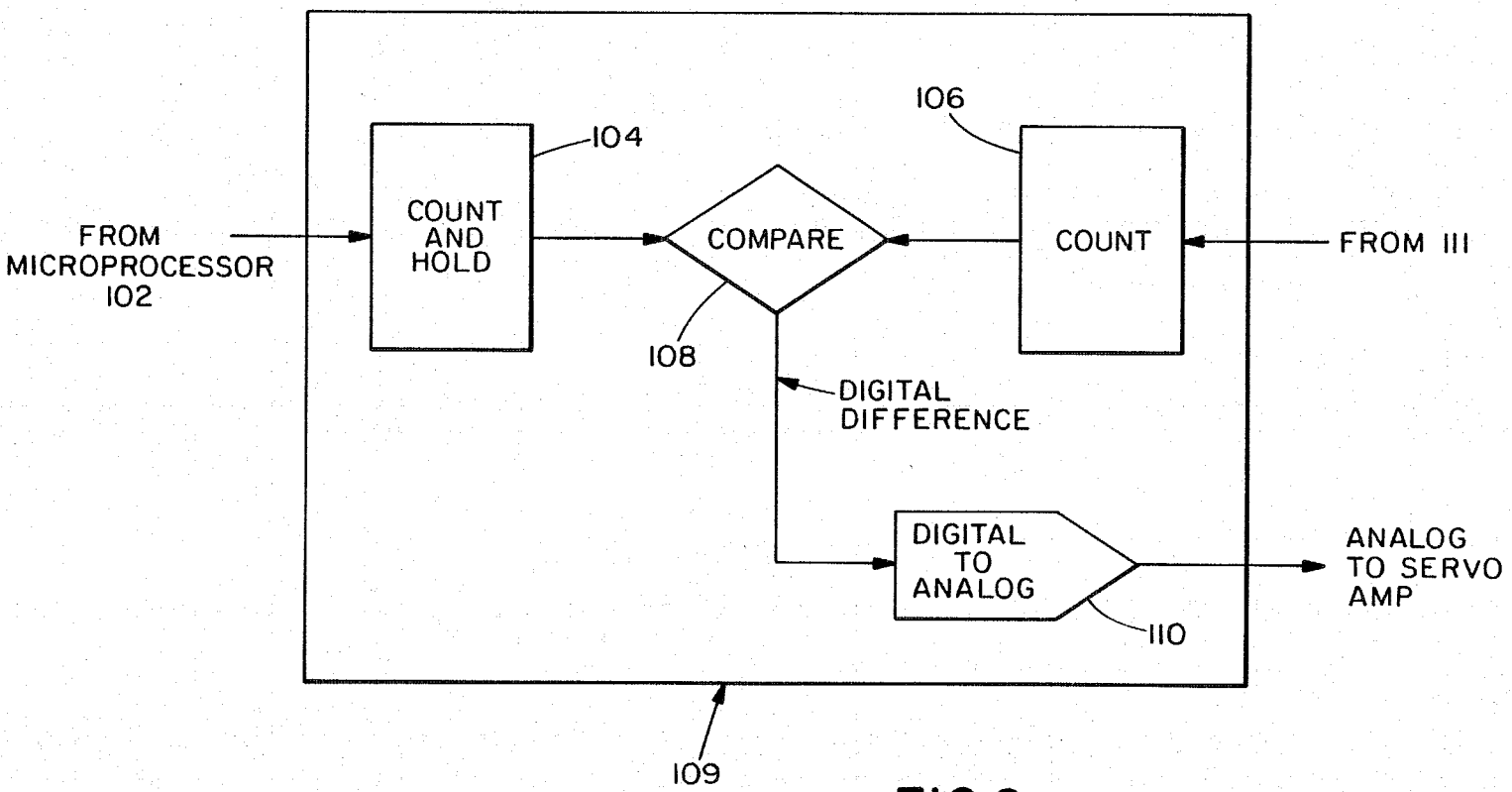
FIG. 9 is a second schematic view of the electronic controller.

Referring to FIGS. 8 and 9, the secondary drive is most preferably controlled by an electronic controller generally designated 101 including a digital computer with a microprocessor 102. The microprocessor 102 receives an electronic signal related to motion characteristics such as speed from a digital tractor rotary encoder 103. The encoder 103 is operatively connected to the tractor 60 for sensing such characteristics and generating such a tractor signal. The microprocessor 102 also receives manual input from a manual selector 105 of the depth of the form sets of the assembly to be burst, and an automatic signal revealing of jamming of the burster generated by a paper sensor 107. The microprocessor 102 generates an output signal to a counting control, which also receives a signal from an electronic, digital, rotary encoder 111. The encoder 111 is operatively connected to the servo motor 50 to sense, from the shaft of the motor 50, the revolutionary position of the rollers 26, 32.

As in FIG. 9, the microprocessor controls the count of a counter 104 in relation to movement of the tractor 60, and the encoder 111 controls the count of a counter 106 in relation to movement of the rollers 26, 32. A comparator 108 compares the counts of the counters 104, 106 and generates an output to a digital-to-analog converter 110 based upon the comparison. The analog output signal of the converter 110 is amplified by a servo amplifier 112 to drive the servo motor 50. The amplifier 112 receives feedback from an analog tachometer 114 operatively connected to the shaft of the motor 50.

The electronic controller automatically, adjustably times the speed of the servo motor 50, and thus the period of intermittency of engagement of the rollers 24, 26, 30, 32 in relation to the manual form depth input and the speed of the tractor 60. The controller also detects drift of the motor 50 and the rollers 24, 26, 30, 32 out of phase with the tractor 60, and corrects for such phase drift.

As most preferred, the controller is adapted to drive the servo motor 50 in ramps of substantially constant acceleration to a peak velocity, and then substantially constant deceleration. For narrow form depths, the rates of acceleration and deceleration are decreased. For long form depths, the rates are increased. As form depths further increase, the ramps are intermittent. Peak velocity occurs while the rollers 26, 32 are engaged with the rollers 24, 30, to assure the rollers 26, 32 are raised from engagement quickly after bursting, to prevent jamming from following form sets.

The invention, and the manner and process of making and using it, are now described in such full, clear, concise and exact terms as to enable any person skilled in the art to which it pertains, to make and use the same. It is to be understood, of course, that the foregoing describes a preferred embodiment of the present invention and that modifications may be made therein without departing from the spirit or scope of the present invention as set forth in the claims. To particularly point out and distinctly claim the subject matter regarded as invention, the following claims conclude this specification.

We regard as invention and claim:

1. Apparatus adapted to burst form sets from continuous business form assemblies along burst lines and adapted to be adjustable to varying form set depths, the apparatus comprising:

a frame;

an intermittently operatively cooperating pair of entry rollers on the frame, a first of the entry rollers being rotatable about a first axis of rotation and revolvable about a first axis of revolution; and an intermittently operatively cooperating pair of exit rollers on the frame, a first of the exit rollers being rotatable about a second axis of rotation and revolvable about a second axis of revolution;

the revolutions of the entry and exit rollers being timed relative to each other and adjustably timed relative to the speed of the continuous business form assemblies such that both pairs of rollers operatively cooperate substantially simultaneously with each other, such that both pairs of rollers operatively cooperate while burst lines of the assemblies are between the entry rollers and the exit rollers, and such that the periods of intermittency of the roller cooperation coordinates with the depths of the form sets of the assemblies.

2. Apparatus as in claim 1 further comprising timing means operatively connected to both pairs of rollers for timing the pairs of rollers.

3. Apparatus as in claim 1 in which the first of the entry rollers and the first of the exit rollers are eccentrically mounted to the frame along the axes of revolution.

4. Apparatus as in claim 1 in which both pairs of rollers are mounted to the frame for rovolution about fixed axes.

5. Apparatus as in claim 1 in which both pairs of rollers are mounted on the frame for rotation, in which the first of the pair of entry rollers and the first of the pair of exit rollers are eccentrically mounted rollers and in which the eccentrically mounted rollers press the continuous business form assemblies against the others of the pairs of rollers during a portion of each 360° revolution of said eccentrically mounted rollers.

6. Apparatus as claimed in claim 5 in which the portion of operative cooperation is about 90° out of 360° of revolution.

7. An apparatus as in claim 5 in which the others of the pairs of rollers are non-eccentrically mounted.

8. Apparatus as claimed in claim 1 further comprising feed means for continuously feeding the continuous business form assemblies to the entry rollers.

9. Apparatus as claimed in claim 1 further comprising feed means for continuously feeding the burst form sets from the exit rollers.

10. Apparatus as in claim 1 in which the speeds of revolution of the first entry and the first exit rollers are adjustable in relation to the depths of the form sets of the assemblies.

11. Apparatus as in claim 1 further comprising a breaker between the pairs of rollers.

12. Apparatus as in claim 1 in which the others of the entry and exit rollers are rotatable about axes of rotation and further comprising driving and timing means operative connected to both pairs of rollers for driving and timing the pairs of rollers, the driving and timing means including a secondary drive drivably connected to the first entry roller and the first exit roller adapted to revolve the first entry roller and first exit roller about the axes of revolution, and a primary drive drivably connected to both pairs of rollers adapted to rotate both pairs of rollers about the axes of rotation.

13. Apparatus as in claim 12 further comprising a breaker bar mounted on the frame between the pairs of rollers, and in which the secondary drive drives the breaker bar in time with the revolutions of the first entry and first exit rollers.

14. Apparatus as in claim 12 in which the driving and timing means further includes electronic control means operatively connected to the primary drive and the secondary drive for electronically controlling the secondary drive.

15. Apparatus as in claim 14 in which the electronic control means includes an automatic digital computer, electronic rotational sensing means and a digital-to-analog converter, the electronic rotational sensing means being operatively connected to the secondary drive for sensing the revolutionary characteristics of the first entry and first exit rollers and generating digital electrical feedback signals thereof, the computer being electrically connected to the sensing means and converter, the converter being electrically connected to the secondary drive, and the computer being adapted to receive the digital electrical feedback signals and further being adapted to generate digital control signals for controlling the secondary drive.

16. Apparatus as in claim 15 further comprising a leading form set sensing means electrically connected to the computer and mounted on the frame for sensing the leading form set of assemblies, and generating leading form set signals, the computer further being adapted to receive the leading form set signals and to control the secondary drive relative thereto.

17. Apparatus as in claim 15 in which the computer includes a microprocessor.

18. Apparatus as in claim 15 in which the electronic rotational sensing means includes a rotary encoder.

19. Apparatus as in claim 15 further comprising tractor means for feeding the assemblies to the entry rollers, electronic tractor sensing means connected to the tractor means for sensing characteristics of the tractor means and generating digital tractor signals thereof, the computer being electrically connected to the tractor sensing means to receive the tractor signals and the computer being adapted to control the drives relative to the tractor signals.

20. Apparatus as in claim 19 in which the tractor sensing means includes a rotary encoder.

21. Apparatus as in claim 15 in which the computer includes manual means for manually inputting to the computer form set depth data, the computer controlling the secondary drive in relation to the form set depth data.

22. Apparatus as in claim 15 in which the electronic control means drives the secondary drive in ramps of acceleration and deceleration.

23. Apparatus adapted to burst form sets from continuous business form assemblies along burst lines, the apparatus comprising:

a frame; and nip means on the frame for intermittently nipping and stressing the assemblies across the burst lines to burst the form sets from the assemblies along the burst lines, the nip means including nipping elements having movable axes, and movement means for moving the axes and thereby the nipping elements toward and away from nipping positions about multiple axes of revolution;

in which each nipping element having a movable axis is rotatable about said movable axis, has an axis of revolution, and is revolvable about said axis of revolution.

24. Apparatus adapted to burst form sets from continuous business form assemblies along burst lines, the apparatus comprising:

a frame; and nip means on the frame for intermittently nipping and stressing the assemblies across the burst lines to burst the form sets from the assemblies along the burst lines, the nip means including nipping elements having movable axes, and movement means for moving the axes and thereby the nipping elements toward and away from nipping positions about multiple axes of revolution;

in which at least one of said nipping elements having a movable axis is a roller;

and in which the roller has a roller surface, the movable axis of the roller is an axis of rotation for the roller surface, the roller has an axis of revolution between the roller surface and the axis of rotation, and the roller is revolvable about the axis of revolution.

25. Apparatus as in claim 23 or 24 further adapted to be adjustable to varying form set depths, the nip means being adjustable and the movement means being adjustable for moving the axes and nipping elements toward and away from the nipping positions at adjustable time intervals.

26. Apparatus as in claim 23 or 24 in which each nipping element having a movable axis has an axis of revolution and a nipping surface, the nipping surface being rotatable about said movable axis and eccentric to said axis of revolution.

27. Apparatus as in claim 26 in which the axes of revolution are fixed relative to the frame.

28. Apparatus as in claim 23 in which said nipping elements are rollers.

* * * * *